United States Patent [19]

Spencer

[11] Patent Number: 4,926,757

[45] Date of Patent: May 22, 1990

[54] ELECTRICALLY GROUNDED RAILWAY TRUCK

[75] Inventor: Charles P. Spencer, Staunton, Ill.

[73] Assignee: Amsted Industries Incorporated, Chicago, Ill.

[21] Appl. No.: 302,902

[22] Filed: Jan. 30, 1989

[51] Int. Cl.[5] ..... B61F 5/30

[52] U.S. Cl. ..... 105/224.1

[58] Field of Search ..... 105/199.4, 207, 218.1, 105/224.05, 224.06, 224.1; 191/12 R, 45 R

[56] References Cited

U.S. PATENT DOCUMENTS

| | | | |
|---|---|---|---|
| 1,414,961 | 5/1922 | Kadel | 105/224.06 |
| 3,638,582 | 2/1972 | Beebe | 105/218.1 |
| 3,670,115 | 6/1972 | Munzing | 191/45 R |
| 3,729,599 | 4/1973 | Payen | 191/45 R X |
| 4,236,457 | 12/1980 | Cope | 105/218.1 |
| 4,237,792 | 12/1980 | Somers | 105/199.4 |
| 4,674,412 | 6/1987 | Mulcahy et al. | 105/218.1 |

FOREIGN PATENT DOCUMENTS

| | | | |
|---|---|---|---|
| 2303957 | 1/1974 | Fed. Rep. of Germany | 105/218.1 |
| 2110072 | 10/1980 | Fed. Rep. of Germany | 105/224.06 |

*Primary Examiner*—Andres Kashnikow

*Attorney, Agent, or Firm*—Edward J. Brosius; Charles E. Bouton

[57] ABSTRACT

An improved railway truck is provided having an elastic and internal grounding connection for creating an electrical path from the side frame, around the elastomeric suspension pad, to the bearing adapter allowing the static electricity of the railway vehicle to be discharged at the rail.

1 Claim, 2 Drawing Sheets

ELECTRICALLY GROUNDED RAILWAY TRUCK

BACKGROUND OF THE INVENTION

The present invention relates to trucks for railway vehicles having elastomeric electrically non-conductive suspension pads located between the pedestal roof of the side frames and the bearing adapter, such as is shown in U.S. Pat. No. 4,674,412, and more particularly to an arrangement for grounding the electric static current from the side frame around the elastomeric suspension pad to the bearing adapter for static discharge at the rail.

The grounding connections currently in use today are typically cables which are fastened by connectors to the metal surfaces on either side of the elastomeric suspension pad.

A problem which has often occurred in such grounding connectors is that these cables and connectors are prone to fatigue and failure either from continued use, from physical impact with external objects along the railway route, or from the action of workers during maintenance of the railway trucks.

SUMMARY OF THE INVENTION

Accordingly, an object of the proposed invention is to provide an improved grounding connection which is located internally so as not to be exposed to external impact.

A further object of the proposed invention is to provide an improved grounding connection which is elastic, thereby avoiding the failure and fatigue problems associated with the cables and connectors which are currently in use.

Another object of the proposed invention is to provide an improved grounding connection which will have a long life and is more cost efficient.

By the present invention, it is proposed to overcome the difficulties encountered heretofore. To this end, it has been discovered that an internal and elastic grounding connection may be made between the side frame and the bearing adapter, or similar opposed spaced surfaces, so that a protected electrical path is established around the elastomeric suspension pad allowing the railway truck to be grounded at the rail.

Generally, this is accomplished by forming an aperture in one of the side frame thrust lug or bearing adapter, or similar electrically conducting surface, prior to railway truck assembly and an electrically conductive compression spring or other elastic connector is then placed therein. After the side frame has been positioned over the elastomeric suspension pad and bearing adapter, the compression spring is released and allowed to expand into contact between the bearing adapter and thrust lug. The spring is thus disposed in a location which is internal of the side frame and free of contact from external objects or workers who are maintaining the railway truck. The spring is held in place by a combination of its seating in the aperture and the expansion force continuously biasing it against the bearing adapter and thrust lug, even throughout the movement of the side frame relative to the bearing adapter during operation, thus allowing the connection to be free of fastening connectors.

BRIEF DESCRIPTION OF THE DRAWINGS

Further features of the present invention will be apparent from the following detailed description taken in conjunction with the drawings wherein.

DESCRIPTION OF THE PREFERRED EMBODIMENT

Figure 1:
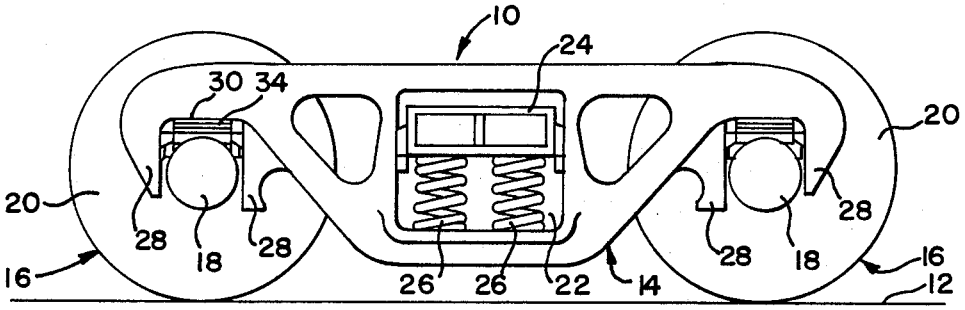
FIG. 1 is a side elevational view of a railway truck to which this invention is to be applied.

An improved railway truck 10 to which the structure of the present invention is applied is shown positioned on rail 12 in FIG. 1. The truck 10, of which only one side is shown comprises generally a pair of side frames 14 mounted on lengthwise spaced wheelsets 16. The wheelsets 16 each include an axle 18 to the outer ends of which there are mounted wheels 20 and roller bearings, (not shown).

The side frames 14 each include a bolster opening 22 in which bolster 24 is resiliently supported by springs 26. Bolster 24 is suitably attached to the underside of the railway vehicle car body (not shown) by means of a center plate (not shown).

Figure 2:
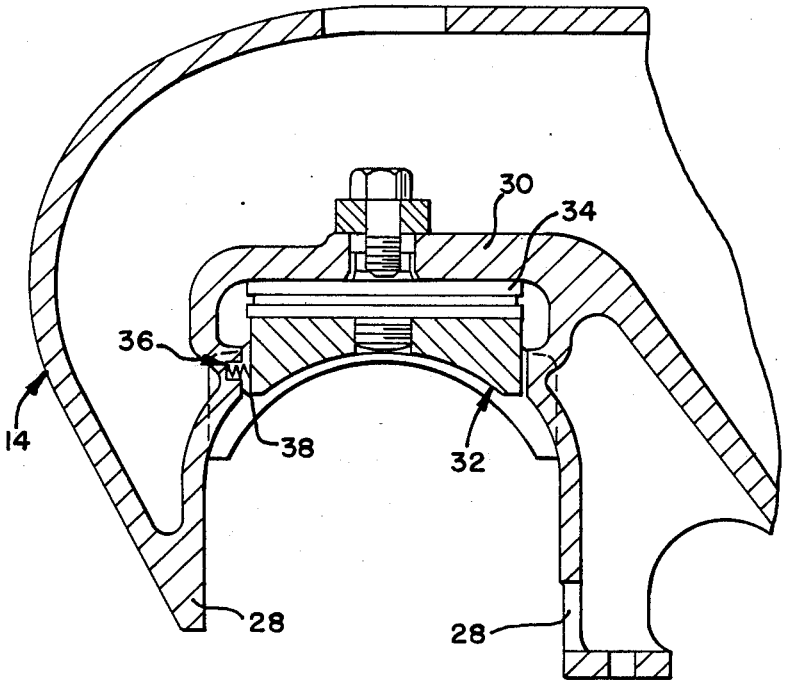
FIG. 2 is an enlarged fragmentary view partially in cross section of one end of the truck of FIG. 1 showing the side frame pedestal jaws and illustrating the present invention and its location between a side frame thrust lug and bearing adapter.

The roller bearings are disposed between pedestal jaws 28—28 projecting downwardly from a pedestal roof 30 of side frame 14. Mounted on the axle 18 is bearing adapter 32 as shown in FIG. 2. An elastomeric suspension pad 34 is disposed between the pedestal roof 30 and the bearing adapter 32. Such elastomeric pads 34 are desirable in that they permit limited relative restrained turning of the wheelsets 16 and side frames 14 when the trucks travel on curved sections of track. However, such pads 34 electrically insulate the side frames 14 and car 10 from the rail 12.

Figure 3:
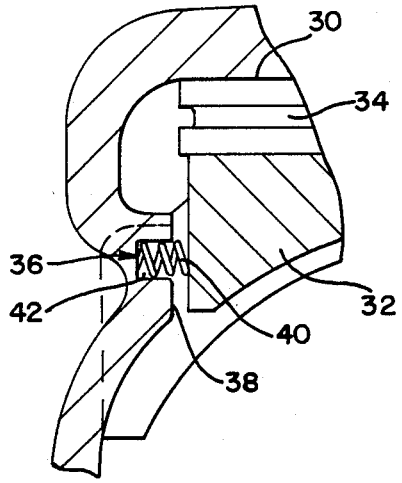
FIG. 3 is a further enlarged fragmentary view of the apparatus of FIG. 2, partially in cross section, illustrating the present invention disposed between a side frame thrust lug and bearing adapter.

One elastic electrically conductive assembly 36 incorporating the present invention is shown in particular in FIGS. 2 and 3. The elastic electrically conductive assembly 36 is disposed between the opposing faces of at least one of the thrust lugs 38 of a side frame 14 and the bearing adapter 32 thereby creating a grounding path for the electric static current to flow so as to be discharged at rail 12.

The elastic electrically conductive assembly 36 includes a metal compression spring 40 which is seated in an aperture 42 formed in thrust lug 38 of side frame 14. Compression spring 40 is placed in aperture 42 in side frame thrust lug 38 in a compressed state during assembly prior to positioning of the side frame 14 over bearing adapter 32 and elastomeric suspension pad 34. After positioning of the side frame 14 over the bearing adapter 32 and elastomeric suspension pad 34, the compression spring 40 is released from its compressed state causing it to expand into a position such that it is in contact with the bearing adapter 32. An electrical path is now established around elastomeric suspension pad 34 grounding railway truck 10 to rail 12.

The seating of compression spring 40 in aperture 42 keeps the compression spring 40 disposed within the side frame 14 away from contact from external objects during operation of the rail car truck, which might otherwise strike and break such a connection.

Figure 4:
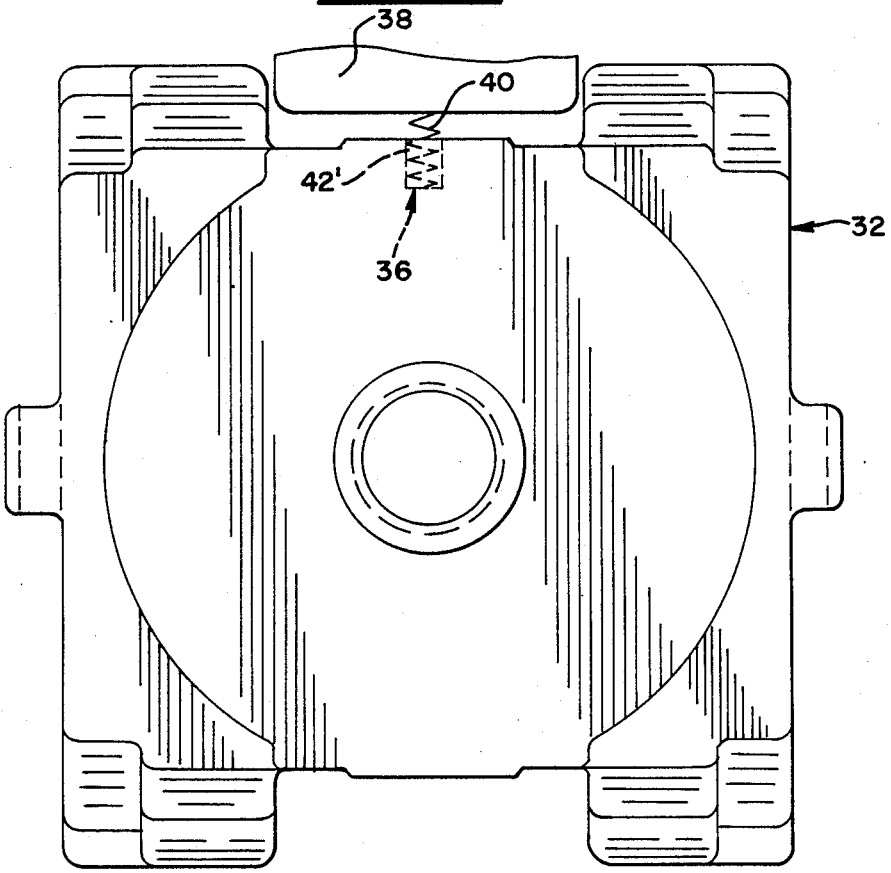
FIG. 4 is a top plan view of the bearing adapter illustrating another embodiment of the invention.

In another embodiment as shown in FIG. 4, aperture 42' is located in bearing adapter 32 instead of side frame thrust lug 38. In a like manner, apertures could be located both in side frame thrust lug 38 and bearing adapter 32.

It should be noted that the elasticity of the elastic electrically conductive assembly 36 is significant. In the prior art devices wherein a wire cable is simply connected at both ends to two electrically conductive spaced opposed surfaces, the wire would often break either due to contact with external objects or fatigue from continued movement of the side frame relative to the bearing adapter during operation. Also each connection of the wire cable to a side frame or bearing adapter was subject to loosening or breakage. An elastic device such as the spring 40 shown in the present invention embodiments has smaller and more infrequent movements allowing for long life and no fastening type connections are needed which can fail.

The foregoing description and drawings explain and illustrate the best known mode of the invention and those skilled in the art who have the disclosure before them will be able to make modifications and variations therein without departing from the scope of the invention which is defined in the following claims.

What is claimed is:

1. An improved railway truck having wheels electrically insulated from side frames by a non-conductive elastomeric suspension pad interposed between said side frame and a wheel-axle bearing adapter, wherein the improvement comprises:

an elastic electrically conductive assembly extending between two spaced opposed surfaces of said side frame and said bearing adapter to form a conductive path between said side frame and said bearing adapter, said conductive assembly comprising a conductive compression spring capable of expanding and contracting sufficiently to keep said spaced opposed surfaces in constant electrical contact throughout relative movement of said side frame and said bearing adapter during operation of said railway truck, said compression spring being seated in an aperture located in one of said spaced opposed surfaces and expanding into contact with the other of said spaced opposed surfaces and being in constant and continuous contact with said side frame and said bearing adapter.

* * * * *